US005232344A

United States Patent [19]

El-Aini

[11] Patent Number: 5,232,344

[45] Date of Patent: Aug. 3, 1993

[54] INTERNALLY DAMPED BLADES

[75] Inventor: Yehia M. El-Aini, Jupiter, Fla.

[73] Assignee: United Technologies Corporation, Hartford, Conn.

[21] Appl. No.: 822,270

[22] Filed: Jan. 17, 1992

[51] Int. Cl.[5] ..... F01D 5/10; F01D 5/26

[52] U.S. Cl. ..... 416/145; 416/500

[58] Field of Search ..... 416/248, 500, 144, 145

[56] References Cited

U.S. PATENT DOCUMENTS

| | | | |
|---|---|---|---|
| 2,689,107 | 9/1954 | Odegaard | 416/500 |
| 2,862,686 | 12/1958 | Bartlett . | |
| 4,118,147 | 10/1978 | Ellis . | |
| 4,441,859 | 4/1984 | Sadler | 416/145 |

FOREIGN PATENT DOCUMENTS

| | | | |
|---|---|---|---|
| 0891635 | 3/1944 | France | 416/500 |
| 1007303 | 5/1952 | France . | |
| 0547530 | 5/1977 | U.S.S.R. | 416/500 |
| 0549581 | 5/1977 | U.S.S.R. | 416/500 |
| 2067675 | 7/1981 | United Kingdom . | |

*Primary Examiner*—John T. Kwon
*Assistant Examiner*—Christopher M. Verdier
*Attorney, Agent, or Firm*—Edward L. Kochey, Jr.

[57] ABSTRACT

A twisted compressor or fan hollow blade is damped by an internal loose slug. The slug contacts the skin of the blade at two transversely spaced locations. This slug is located with its center of gravity eccentric of a radial line through the contact location.

4 Claims, 2 Drawing Sheets

4

Fig. 1
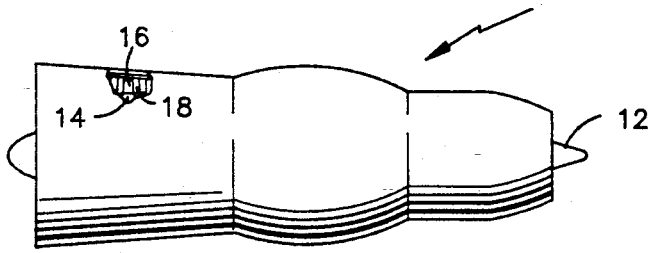
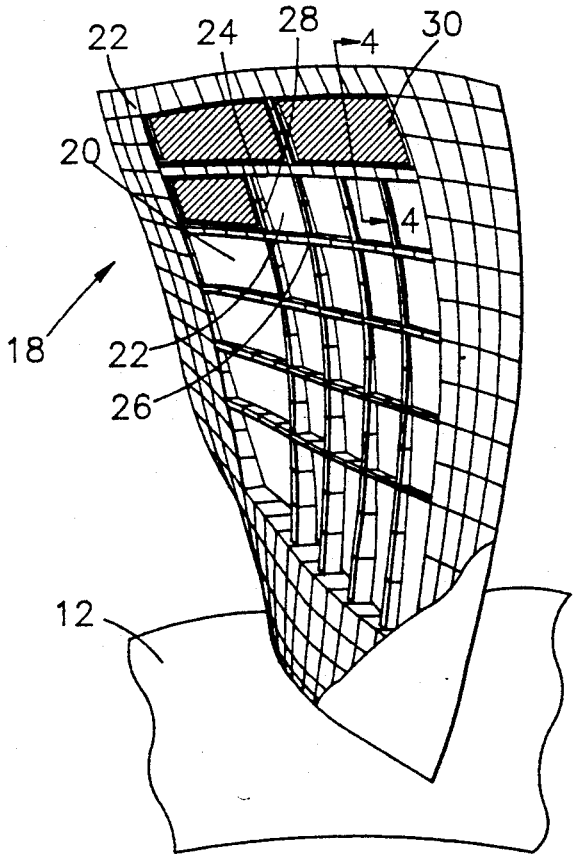
Fig. 2
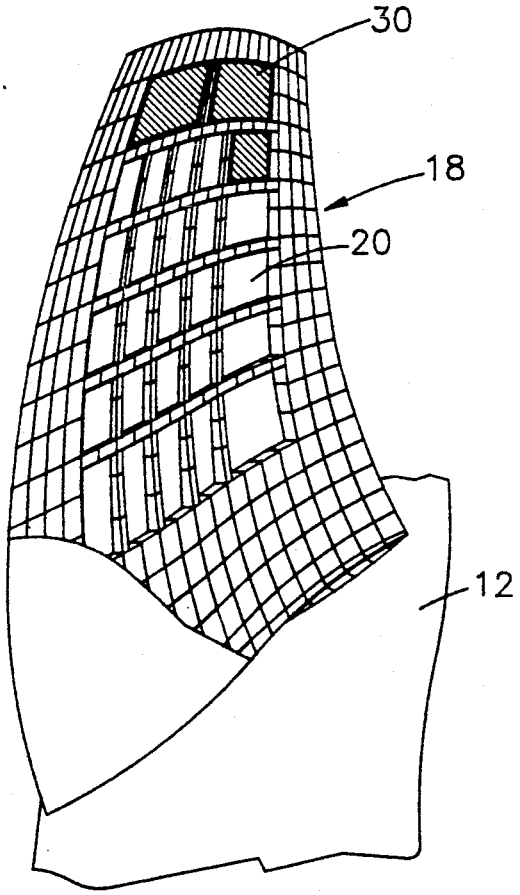
Fig. 3

INTERNALLY DAMPED BLADES

TECHNICAL FIELD

The invention relates to gas turbines and in particular to vibration damping of fan or compressor blades therein.

BACKGROUND OF THE INVENTION

Contemporary gas turbine fan and compressor blade designs lead to high stage loading on low aspect ratio airfoils. These blades experience chordwise vibration at lower frequencies than previous blading. Thus, the potential for resonance crossings occurring at high engine speeds and consequently high energy increases, and can cause significant high cycle fatigue problems. These can result in liberation of portions of the airfoil.

Earlier design philosophies to overcome such problems included the incorporation of mid-span shrouds and tip shrouds to increase the chordwise stiffness. This also increased the system mechanical damping level. Other approaches are those such as shown in U.S. Pat. No. 4,118,145 issued Oct. 3, 1978 which incorporate composite reinforcement to portions of the airfoil tip section to strengthen it against chordwise "strip" modes of vibration.

Hollow blades are preferred in modern engines because of the light weight, but these blades have increased vibration problems.

SUMMARY OF THE INVENTION

A twisted hollow fan or compressor airfoil blade extends radially from the rotor shaft. It has a plurality of internal chambers, each one bounded by the blade skin on two sides. A slug is located within at least one of these chambers, with the slug under the influence of centrifugal force in contact with the outboard section and also with one of the skins. It is in contact with the skins at two transversely spaced locations so that friction occurs between the two components during chordwise flexure of the airfoil.

BRIEF DESCRIPTION OF THE DRAWINGS

FIG. 1 is a schematic of a gas turbine engine;

FIG. 2 is an axial view of a hollow fan blade;

FIG. 3 is a tangential view of a hollow fan blade;

DESCRIPTION OF THE PREFERRED EMBODIMENT

Figure 4:
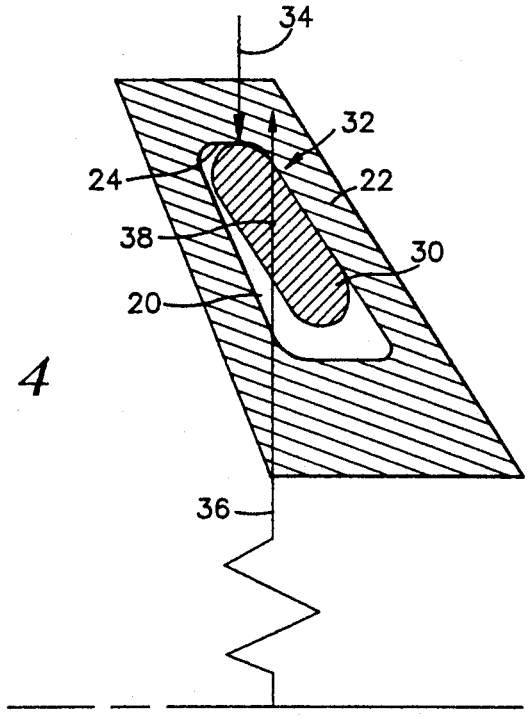
FIG. 4 is a section taken at section 4—4 of FIG. 2.

FIG. 1 illustrates a gas turbine engine 10 with a rotor 12 including a compressor disk 14. The compressor disk carries compressor airfoil blades 16 located in the gas flowpath 18.

As seen in FIGS. 2 and 3, the blade 18 extends radially from the fan rotor shaft 12. It includes a plurality of internal chambers 20. Each chamber is bounded by the blade skin 22 on two sides and also an outboard circumferential section and an inboard section 26. Two radially extending side sections 28 complete the enclosure.

A slug 30 is located within one of the chambers with the slug under the influence of centrifugal force in contact with an outboard section 24 of the chamber.

It is also in contact with skin 22 at at least two transversely spaced locations on the skin. Accordingly, force 32 is imposed on the slug 30 by the skin and flexing of the airfoil causes differential movement along the length of the slug and frictional resistance with effects damping of the blade.

Radial line 34 through the contact location 24 is eccentric of the radial line 36 through the center of gravity 38. This assures that there is force against the sidewall rather than only at point 34 which is required to provide damping effectiveness. Damping is provided when slipping between damper 30 and skin 22 occurs under normal load 32.

Figure 5:
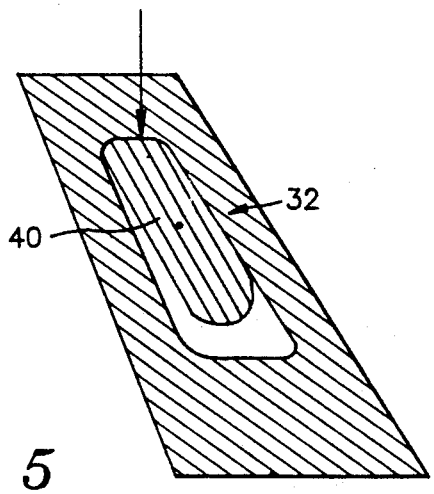
FIG. 5 is an embodiment where the slug is formed of shims.

In FIG. 5 the slug 30 of a single material is replaced by a plurality of shims 40 which function in a similar manner to the slug 30. These shims, however, have an advantage in that they slip relative to each other in addition to slipping of the damper 30/shim 22 interface, thus providing a higher level of damping effectiveness.

I claim:

1. A twisted hollow fan or compressor airfoil blade extending radially from a rotor shaft comprising:

a plurality of internal chambers within said blade, each chamber bounded by the blade skin on two sides, a circumferentially extending outboard section, an inboard section and two radially extending end sections; and a slug located within at least one of said chambers, said slug under the influence of centrifugal force in contact with said outboard section at an outboard contact location and one of said skins at a skin contact location, said contact with one of said skins extending to at least two transversely spaced locations on said skin.

2. An airfoil blade as in claim 1 comprising also:

the center of gravity of said slug located eccentrically of a radial line through said outboard contact location.

3. An airfoil blade as in claim 1 comprising also:

said slug comprised of a plurality of parallel contacting unbonded shims.

4. An airfoil blade as in claim 2 comprising also:

said slug comprised of a plurality of parallel contacting unbonded shims.

* * * * *